US007544134B1

(12) United States Patent
Harmon et al.

(10) Patent No.: US 7,544,134 B1
(45) Date of Patent: Jun. 9, 2009

(54) ACCESSORY FOR TRANSFORMING A GOLF PUTTER INTO A BELLY PUTTER

(76) Inventors: Norman Harmon, 401 Mishannock Way, Chesapeake, VA (US) 23323; Richelle A. Harmon, 401 Mishannock Way, Chesapeake, VA (US) 23323

( * ) Notice: Subject to any disclaimer, the term of this patent is extended or adjusted under 35 U.S.C. 154(b) by 3 days.

(21) Appl. No.: 12/044,001

(22) Filed: Mar. 7, 2008

(51) Int. Cl.
*A63B 69/36* (2006.01)
*A63B 53/16* (2006.01)

(52) U.S. Cl. ..... 473/206; 473/239; 473/296

(58) Field of Classification Search ..... 473/206, 473/219, 226, 227, 231, 238, 239, 294, 296, 473/299
See application file for complete search history.

(56) References Cited

U.S. PATENT DOCUMENTS 3,188,086 A * 6/1965 Parmley ..... 473/227
3,572,720 A 3/1971 Berg
3,656,752 A 4/1972 Moriarty
4,334,684 A 6/1982 Sterling
5,156,401 A 10/1992 Hodgkiss
5,180,168 A 1/1993 Balestrieri
5,452,891 A * 9/1995 Thomas ..... 473/294
5,520,392 A 5/1996 Foresi
5,531,446 A * 7/1996 Scheie et al. ..... 473/227
5,649,870 A * 7/1997 Harrison ..... 473/239
5,730,661 A 3/1998 Kozub
5,976,030 A * 11/1999 Hsieh ..... 473/296
6,196,930 B1 * 3/2001 Aumock ..... 473/206
6,213,890 B1 * 4/2001 Prince ..... 473/292
6,364,787 B1 * 4/2002 Huiskamp ..... 473/294
6,394,911 B1 5/2002 Vaughn
6,595,865 B2 7/2003 Stitz
6,896,626 B2 * 5/2005 Drossos ..... 473/294
7,147,568 B1 * 12/2006 Butler ..... 473/239
2003/0050131 A1 * 3/2003 Grace ..... 473/296
2006/0183563 A1 * 8/2006 Nemeckay ..... 473/239

* cited by examiner

*Primary Examiner*—Nini Legesse

(57) ABSTRACT

An accessory for a golf putter to make that putter into a putter with the feel of a belly putter. The accessory temporarily extends a regular putter to simulate the feeling of a belly putter.

3 Claims, 1 Drawing Sheet

ACCESSORY FOR TRANSFORMING A GOLF PUTTER INTO A BELLY PUTTER

TECHNICAL FIELD OF THE INVENTION

Figure 1:
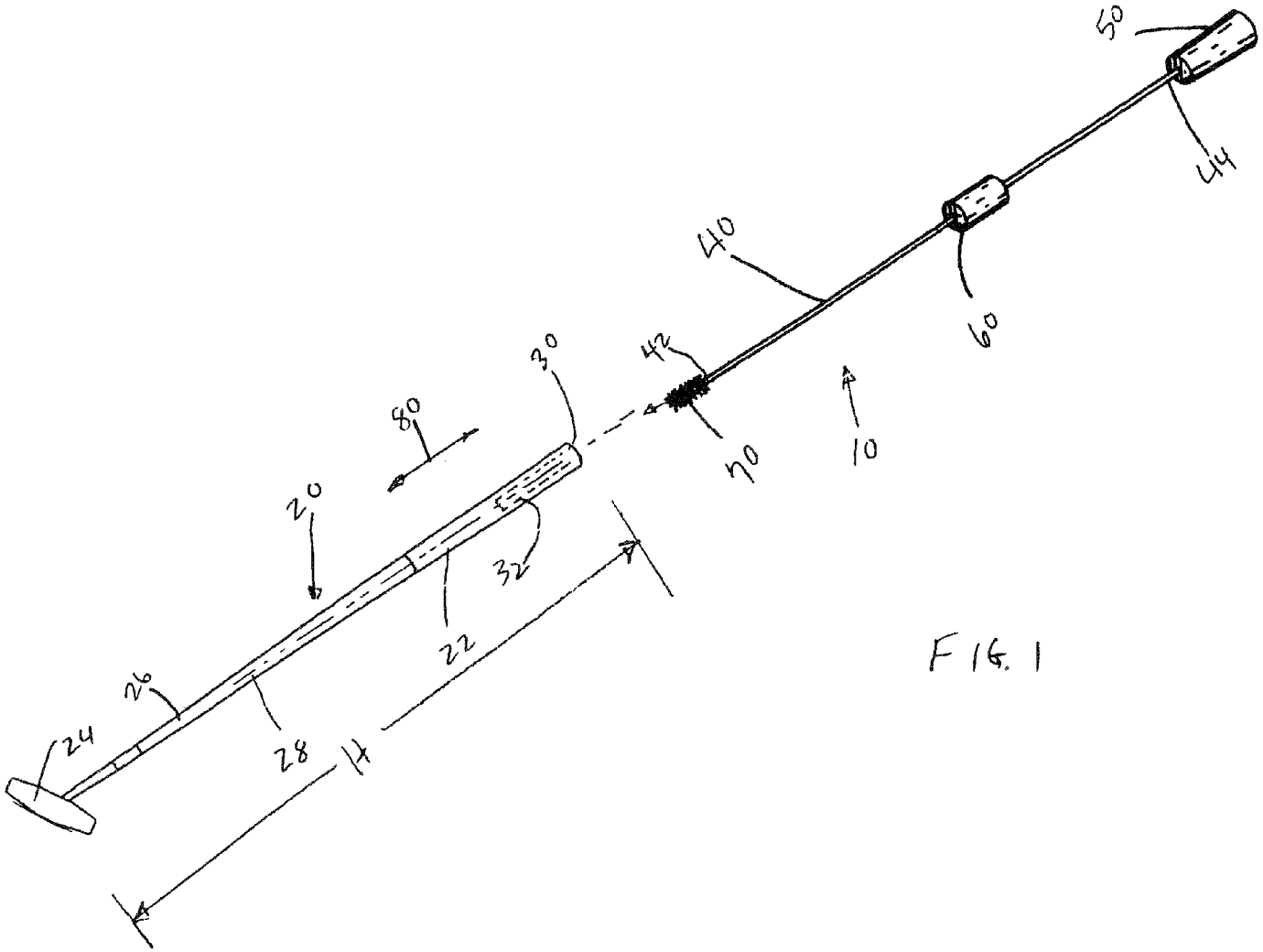

The present invention relates to the general art of golf, and to the particular field of golf accessories.

BACKGROUND OF THE INVENTION

Modern golf is considered to be a Scottish invention. The first game of golf for which records survive was played at Bruntsfield Links, in Edinburgh, Scotland, in 1456, recorded in the archives of the Edinburgh Burgess Golfing Society.

Golf is governed by The Rules of Golf as approved by the United States Golf Association and the Royal and Ancient Golf Club of St. Andrews, Scotland, referred to herein as the USGA Rules. The most current rules are available from www.USGA.org. A typical game of golf is played on a course having 18 holes and a golfer may carry up to 14 clubs with him during play. An average golfer uses over 80 strokes to complete the game, and typically half of those stokes are putts. Therefore, the putter is by far the most important of the regulation 14 golf clubs in a golfer's bag, and improved putting will improve a player's score more than improvement in any other stroke.

In many respects, the correct use of the putter represents a more difficult problem for golfers than the other clubs. This is due to the relative delicacy and reduced arc of the putting stroke, and the necessity for striking the ball with the face of the putter precisely perpendicular to the intended path of the ball and for maintaining this position of the putter during the entire putting stroke. Accuracy of stroking is more important with the putter than with any other club because of the small target at which the ball is directed, and the absolute requirement that unless the indicated relation of the club face and the ball is established, the ball will be irregularly struck and thereby off the intended line.

Consequently, thousands of devices and methods have been devised to help a golfer improve his putting, ranging from the practical to the absurd. Most of these devices do not conform to the-design of clubs specified by the USGA Rules, however, and therefore are used during practice only. The golfer must switch putters to play a round of golf, thus changing the primary tool with which he perfected his stroke. As a result, the putt stokes during play are seldom as good as during practice. It would be advantageous, then, to provide a dual-purpose putter that conforms to the Rules of Golf so that the golfer can use the same putter in practice as in play.

Under the USGA Rules, the putter shall have a shaft and a head, fixed to form one unit. When the golf club is in its normal position to address the ball, the shaft shall be aligned so that the projection of the straight part of the shaft onto the vertical plane through the toe and heel shall diverge from the vertical by at least 10 degrees. Further, the projection of the straight part of the shaft onto the vertical plane along the intended line of play shall not diverge from the vertical by more than 20 degrees. The USGA Rules further require that the clubhead meet specific criteria. For example, the distance from the heel to the toe of a putter shall be greater than the distance from the play face to the back. These rules limit the orientation of the shaft to the clubhead, and therefore the balance of the putter, a major factor in aligning the ball and in putting consistently.

Unlike the proper position or stance of a golfer when hitting a golf ball with other golf clubs, it is generally agreed that when putting a golfer should bend forward and place his eyes over the ball, in the vertical plane of the ball and looking down at the ball along a line which is normal to the portion of the putting surface on which the ball lies. Novice golfers have a tendency to stand too straight when putting and consequently look at the ball along a slanted line. Even experienced golfers, when their putting deteriorates, find that they are not getting their eyes directly over the ball and looking at the ball along a straight line passing through the ball and normal to the portion of the surface on which the ball lies. Failure of a player to properly position his eyes while putting results in failure to have the head of his putter properly positioned at the moment it strikes the ball. Instead of being parallel to the putting surface and normal to the line of travel desired for the ball the outer end of the putter head may be angled up and the face of the putter may be "open" or "closed" instead of normal to the desired line of travel.

Therefore, there is need for a device by which a player in practice putting may train himself to properly position himself with respect to the ball. One of the main causes for high scores in the game of golf is faulty putting on the green in the final phase of the golfer's effort to sink his ball into the target hole. The inventor has found that a key to proficient putting in playing the game of golf, lies in developing a consistent putting stroke. The direction that a ball takes when rolling on a green toward a hole depends upon three major variables. The first critical factor in executing a proper putting stroke is the club head path.

To make the ball roll in precisely the intended direction it is necessary that the golfer swing the putter within and in parallelism with a vertical plane containing the intended line of direction. Frequently, however, golf players depart from this plane, either at the beginning and/or the end of the putting stroke, and in this matter impart to the ball a slightly misdirected moment as the head of the putter makes contact with ball. In practicing putting to overcome the described putting defect, it is often difficult, if not impossible, for the player to judge whether his club departed laterally from parallelism with the vertical plane containing the desired line of advance of the ball, and it is therefore necessary for him to ask friends or an instructor to watch his practice strokes.

It has further been found that lateral motion (motion perpendicular to the desired trajectory of the ball and parallel to the ground), if present in a putting stroke during impact with the ball, may cause the ball to diverge from the golfer's intended trajectory. To avoid this, a golfer's putting stroke should contain no lateral motion. In this regard, it follows that a putting practice device should train the golfer to consistently use a putting stroke free of lateral motion.

A second factor is the position of the club face relative to the ball, that is, whether the club face is open or closed. It has been found that lateral motion (motion perpendicular to the desired trajectory of the ball and parallel to the ground), if present in a putting stroke during impact with the ball, may cause the ball to diverge from the golfer's intended trajectory. To avoid this, a golfer's putting stroke should contain no lateral motion. In this regard, it follows that a putting practice device should train the golfer to consistently use a putting stroke free of lateral motion. In this regard, it follows that a putting practice device should train the golfer to consistently use a putting stroke free of lateral motion.

A third factor is the location on the putter striking face where the ball is actually struck, it being appreciated that hitting a ball precisely at the center of percussion will produce the truest and straightest roll. It has long been thought that the putting stroke was a miniature of a full golf swing; that is, the club head moves in an arcuate path by being brought back on an inside path during the back swing, returned to a square position at impact, and returned on an inside path during the follow through. This motion opens the club face during the back swing portion of the stroke and closes it during the follow through portion of the stroke relative to the line a golf ball must roll in order to be holed. By opening and closing the putter club face, consistency in the execution of a golf stroke becomes much more difficult.

The inventor has found that a more scientific approach to developing a pure putting stroke concludes that the stroke should emulate a pure pendulum movement, whereby the putter face remains square and follows a straight line path with a straight back, straight through motion coincident with the aim line a golfer has selected after reading the green surface in order to hole the golf ball. This straight path motion minimizes deviations in the path of the putter head, which commonly occur with an arcuate stroke, and also aids in maintaining the club face perfectly square throughout the full extent of the putting stroke including the back swing, and the impact position and the follow through.

Therefore, there is need for a device that causes the golfer to move the putter in a pendulum motion during a putting stroke. One method of doing this is to use a so-called "belly putter" in which a top end of the putter is placed in abutting contact with the stomach of the golfer and the golfer grips the shaft of the putter. The abutting contact between the club and the golfer acts as a fulcrum about which the putter is swung in a pendulum motion.

Due to this positioning of the putter, a golfer's regular putter may not work as a belly putter. Therefore, the golfer may be forced to purchase a second putter if he or she wishes to practice their putting using a belly putter. Furthermore, because golfer's have different heights, a single putter will not fit all golfers. Again, a golfer may be forced to purchase additional putters in order to have a practice club that is most efficient and effective. Of course, this can be costly. In some instances, the belly putter, while efficient and suitable for practice, may not be suitable for use during an actual round of golf.

The penalty for playing a game of golf with a putter that does not conform to the USGA Rules is disqualification from the game. However, with the many rules pertaining to the design of putters, it is difficult to design a club that provides quality training features for practicing and yet can be used for play. Accordingly, there is a need for a putter that can be used for practice and play and that conforms to USGA Rules.

SUMMARY OF THE INVENTION

These, and other, objects are achieved by an accessory for a golf putter to make that putter into a putter with the feel of a belly putter. The accessory temporarily extends a regular putter to simulate the feeling of a belly putter. More specifically, the accessory includes a metal rod that is at least ⅛ inch in diameter and ranges from 25 inches to 31 inches in length. One end of the rod has thereon a cap that is the same diameter as a putter grip. The rod is collapsible and has a rubber sleeve ¾ inches thick located below the cap. The sleeve holds the unit in place once extended out. The rod itself slides up and down. The end of the rod that fits into the grip of a golf putter can be fitted with helical brush like material, such as flexible bristles which are arranged in a helix along the axis of the rod, in order to help secure it into the putter.

The device of the present invention fits into the grip of the putter and can be extended into the user's stomach region. It is designed to adjust to the player's height and girth. With this arrangement, a standard putter feels more like a belly putter for practice purposes. It can improve putting performance because it is adjustable with an already existing putter. The configuration simulates a standard belly putter because the end section that contacts the stomach region is the tip of the putter grip. Since the device slides into the putter itself, this eliminates the need to purchase a new putter in order to get the feel of using a belly putter. The device also allows a user to customize the thus formed belly putter to his or her exact size.

The accessory of the present invention helps golf enthusiasts to improve putter performance and accomplish a true pendulum swing. The present invention creates this movement through adapting the normal putting head into a belly putter.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURE

The invention can be better understood with reference to the following drawing and description. The components in the FIGURE are not necessarily to scale, emphasis instead being placed upon illustrating the principles of the invention. Moreover, in the figure, like referenced numerals designate corresponding parts throughout the different views.

FIG. 1 is a perspective view of an accessory embodying the principles of the present invention in combination with a golf putter.

DETAILED DESCRIPTION OF THE INVENTION

Referring to the FIGURE, it can be understood that the present invention is embodied in a golf accessory 10 for use with a golf putter 20 to transform that golf putter into a belly putter in which the top end of the belly putter engages the stomach area of the user whereby the putter is operated in a pendulum motion. As can be understood from the FIGURE, golf putter 20 has a hand grip 22 connected to a head 24 by a shaft 26 that has a longitudinal axis 28. Height dimension H of the golf putter is defined between end 30 of golf hand grip 22 and the head 24. Golf putter 20 has a bore 32 defined therein to extend in the direction of the longitudinal axis from end 30 toward head 24. As will be understood by those skilled in the art, the height dimension of the golf club is set by the manufacturer and generally requires the golfer to bend over to execute a golf putt.

This has created several problems in the past, and the belly putter is intended to overcome these problems. Golf accessory 10 is designed to transform golf putter 20 into a belly putter without requiring the golfer to purchase another golf club. Accessory 10 is further designed to have the ability to be customized for the exact needs of the golfer.

Accessory 10 is attached to golf grip 22 of the golf putter to extend in a direction which is co-linear with the longitudinal axis 28 and to increase the length of shaft 26 of the golf putter as necessary to transform putter 20 into a belly putter. Accessory 10 comprises a shaft 40 which has a first end 42 which is a bottom end when the shaft is in use and a second end 44 which is a top end when the shaft is in use. The use condition of the accessory is indicated in the FIGURE as being attached to the golf grip end of the golf putter. In the use condition with the accessory attached to the golf putter, shaft 40 is accommodated in bore 32.

A cap 50 is located on the top end of the shaft. The cap is sized and configured to abuttingly contact a stomach of a user when the shaft is in use, and is sized to simulate a golf putter hand grip. A sleeve 60 is slidably mounted on the shaft. The sleeve can be formed of rubber or the like and is used to secure the shaft to the golf putter.

A connecting element 70 is located on the bottom end of the shaft and is sized and adapted to frictionally engage the golf putter hand grip end 22 and connect the shaft to the putter hand grip so shaft 40 extends from end 22 in the direction that is co-linear with longitudinal axis 28 so the overall height of the accessory/golf club combination as measured between golf club head 24 and top end 44 of the accessory is sufficiently so shaft 40 and the golf putter associated therewith form a golf putter element which is operated by placing the top end of the shaft against the user's stomach and the user gripping shaft 26 of the golf putter to move the golf putter and accessory shaft in a pendulum motion with the stomach-engaging end of the shaft being a fulcrum. Once the shaft is attached to the golf putter, the sleeve can be moved down into abutting contact with the top of the golf putter hand grip to hold the shaft connected to the golf putter.

As indicated by double-headed arrow 80, the shaft can move into and out of bore 32 to be telescopic with respect to the golf putter hand grip. This allows the shaft and putter to be customized to fit the exact needs of the user. Connecting element 70 can include bristles or the like. The bristles can be metal and can be designed to easily move into the shaft of the golf club but to securely hold shaft 40 connected to the golf club when the accessory is to be connected to the golf club. The bristles can also be sufficiently flexible to carry out this attaching function but permit the accessory to be removed from the golf club when desired. The temporary extension of the golf putter allows a user to practice proper putting technique using a pendulum motion, and then remove the accessory so the putter is returned to its non-modified configuration for use on the golf course. The practice club can thus be non-compliant with golf requirements if suitable, while the club actually used can be compliant with the rules of golf, without requiring the golfer to purchase two separate clubs. The golfer can thus select and customize the practice club as required for efficient and effective practice without worrying about whether or not the customized club complies with USGA rules because after the accessory is removed from the putter, the putter will be compliant and as supplied by the manufacturer.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A golf accessory comprising:

A) a golf putter which has a shaft and which includes
   1) a first end which is a bottom end when the golf putter is in use,
   2) a second end which is a top end when the golf putter is in use,
   3) a putting head on the first end,
   4) a golf grip on the shaft adjacent to the second end,
   5) a bore defined in the shaft of the golf putter to extend from the second end of the shaft of the golf putter toward the first end of the shaft of the golf putter, and
   6) a height dimension that is measured between the putting head and the second end;

B) a bore defined in the shaft adjacent to the second end to extend from the second end toward the first end of the shaft;

C) an extension device for converting the golf putter into a belly putter comprising:
   1) a shaft having a first end which is a bottom end when the extension device is in use and a second end which is a top end when the extension device is in use,
   2) a connecting element on the shaft of the extension device adjacent to the first end of the shaft of the extension device, the connecting element releasably connecting the means to the shaft of the golf putter for use and including metal brushlike bristles which frictionally engage the shaft of the golf putter adjacent to the bore defined in the shaft of the golf putter to hold the shaft of the extension device to the shaft of the golf putter with the shaft of the extension device extending away from the shaft of the golf putter to define an overall height dimension as measured between the putting head and the second end of the shaft of the extension device,
   3) a connecting sleeve slidably mounted on the shaft of the extension device, and
   4) a cap on the shaft of the extension device adjacent to the second end of the shaft of the means, the cap being sized and shaped to correspond to the size and shape of the golf grip on the shaft of the golf putter, the cap having a distal end which engages against a user's stomach when in use to define a pivot point with the user gripping a shaft of the golf putter to move the golf putter and shaft of the extension device in a pendulum motion with the stomach-engaging distal end of the cap being a fulcrum; and D) the extension device being separable from the golf putter.

2. The golf accessory defined in claim 1 wherein the shaft is telescopic with respect to the golf putter grip.

3. The golf accessory defined in claim 1 wherein the sleeve is rubber.

* * * * *